US006510565B1

(12) United States Patent
Zwezdaryk

(10) Patent No.: US 6,510,565 B1
(45) Date of Patent: Jan. 28, 2003

(54) PORTABLE AND COLLAPSIBLE SAUNA

(76) Inventor: Shane Zwezdaryk, 46 Hyde Avenue, Apt. #2, Toronto, Ontario (CA), M6M 1J4

( * ) Notice: Subject to any disclaimer, the term of this patent is extended or adjusted under 35 U.S.C. 154(b) by 0 days.

(21) Appl. No.: 09/950,065

(22) Filed: Sep. 12, 2001

(51) Int. Cl.[7] ..... A61H 33/06

(52) U.S. Cl. ..... 4/531; 4/524; 4/526; 4/534; 135/92; 135/137

(58) Field of Search ..... 4/524, 525, 526, 4/527, 531, 533, 534; 135/92, 137

(56) References Cited

U.S. PATENT DOCUMENTS 646,572 A * 4/1900 Floyd ..... 4/527
945,241 A * 1/1910 Mayer ..... 4/534 X
1,475,091 A * 11/1923 Thomas ..... 4/533
2,197,478 A * 4/1940 Mathieu ..... 4/527 X
2,864,097 A * 12/1958 Schoneberg ..... 4/527
6,363,955 B1 * 4/2002 Louie ..... 135/137 X

FOREIGN PATENT DOCUMENTS

GB 183472 * 12/1922 ..... 4/527

* cited by examiner

*Primary Examiner*—Robert M. Fetsuga
(74) *Attorney, Agent, or Firm*—Gowling Lafleur Henderson LLP

(57) ABSTRACT

A portable and collapsible sauna is provided, including an enclosure adaptable between a collapsed position and an upstanding position and a steam generator. The portable and collapsible sauna is configurable between these two positions by a latch mechanism. In order to achieve the sauna experience, the steam is trapped by the enclosure and the enclosure is adapted to facilitate ingress and egress of a user, while maintaining a seal for the steam. The fully assembled sauna is preferably dimensioned to fit in a standard bathtub.

9 Claims, 5 Drawing Sheets

PORTABLE AND COLLAPSIBLE SAUNA

FIELD OF THE INVENTION

This invention relates to portable and collapsible saunas, in particular to a collapsible sauna with easy assembly and disassembly.

BACKGROUND OF THE INVENTION

Portable and collapsible saunas are known. The main advantage of these types of saunas over permanent saunas is portability enabling them to be used in any location. However, some prior art saunas require tools and a considerable amount of time to assemble.

Several solutions have been proposed, for example, U.S. Pat. No. 5,511,254 teaches a structure including a plurality of detachable frame members covered by an enclosure material. However, assembly of such a structure is complicated and the structure requires a space to be dedicated for erection. Also, U.S. Pat. No. 3,945,058 teaches a sauna apparatus including a tent overlying and enclosing a cot. Located at one end of the tent is a hole for enabling a patron to recline on the cot with his head extending through the hole. Two drawbacks of this invention are that the user's head must be placed outside the tent, and since the patron has to lie down on the cot, only a certain percentage of the user's body is subject to the sauna experience. Yet another drawback of this invention is a tendency of condensation to drip onto their body in the tent during use.

Accordingly, it is an object of this invention to provide a collapsible and portable sauna that can be easily assembled and dissembled.

It is a further object of this invention to provide a portable sauna which doesn't drip onto an occupant and which will fit into a bathtub thereby avoiding potential damage to a floor.

SUMMARY OF THE INVENTION

A portable sauna is provided which has a collapsible frame dimensioned to fit within a bathtub and configurable between an erected and collapsed configuration by resilient bending. A collapsible cladding is mounted over the frame and defines an enclosure when the frame is in the erected configuration. A doorway is provided through the cladding for permitting ingress and egress and a door is mounted to the cladding for closing the doorway. A steam generator is mounted within the enclosure.

The enclosure is may have a downwardly facing generally concave shaped top to direct any moisture condensing thereon along the collapsible cladding.

The sauna may further include a base substantially of cedar within the enclosure.

The collapsible frame may be securable to the base.

The cladding may have an opening therethrough for admitting a hand-held shower.

The portable sauna may further include at least one seat erectable within the enclosure and the seat may be of knockdown configuration.

BRIEF DESCRIPTION OF THE DRAWINGS

Further objects and advantages will become apparent upon reading the following detailed description in conjunction with the drawings in which.

DETAILED DESCRIPTION OF THE PREFERRED EMBODIMENT

Figure 1:
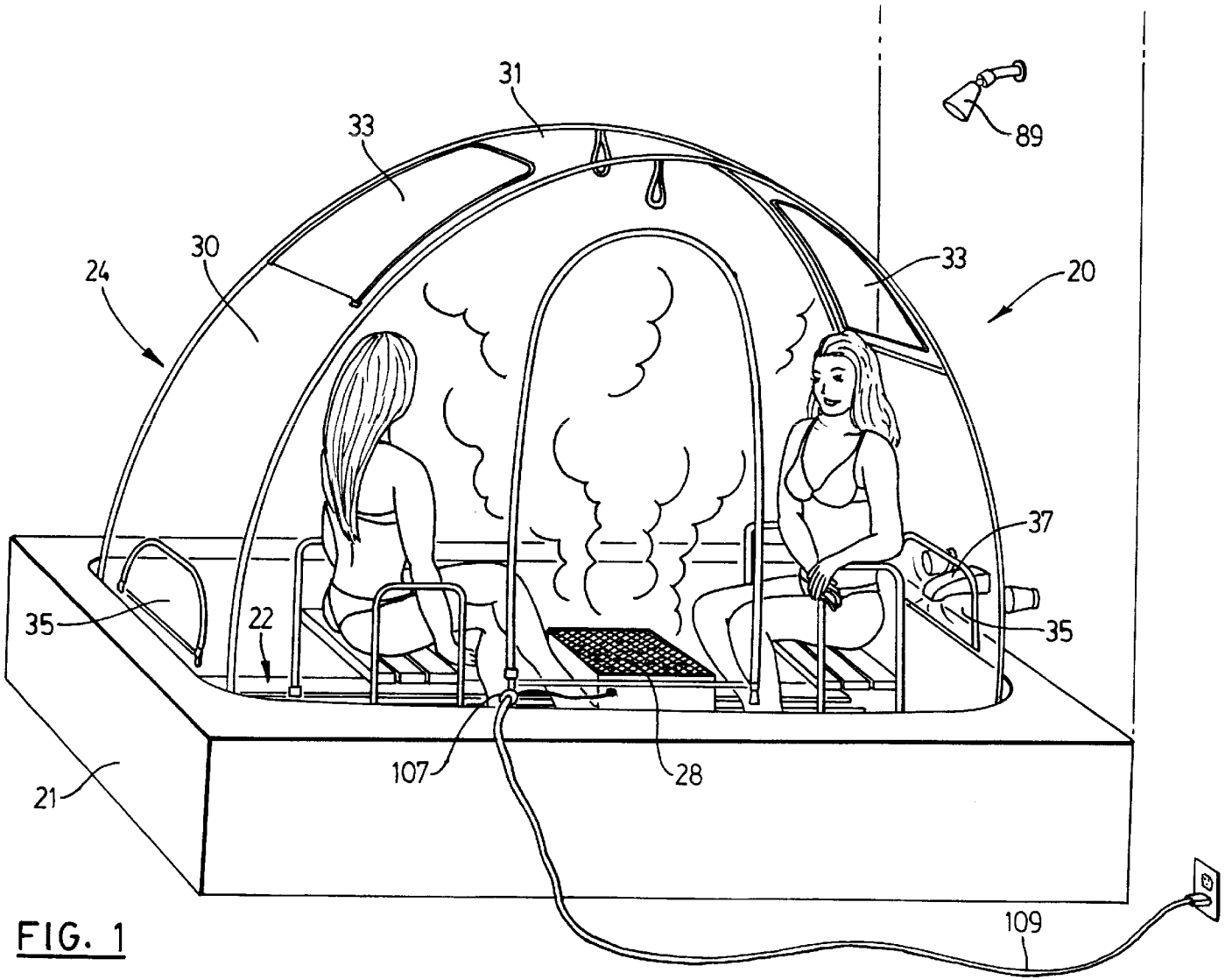
FIG. 1 is a perspective view of a portable sauna according to the present invention in use in an erected configuration.
Figure 4:
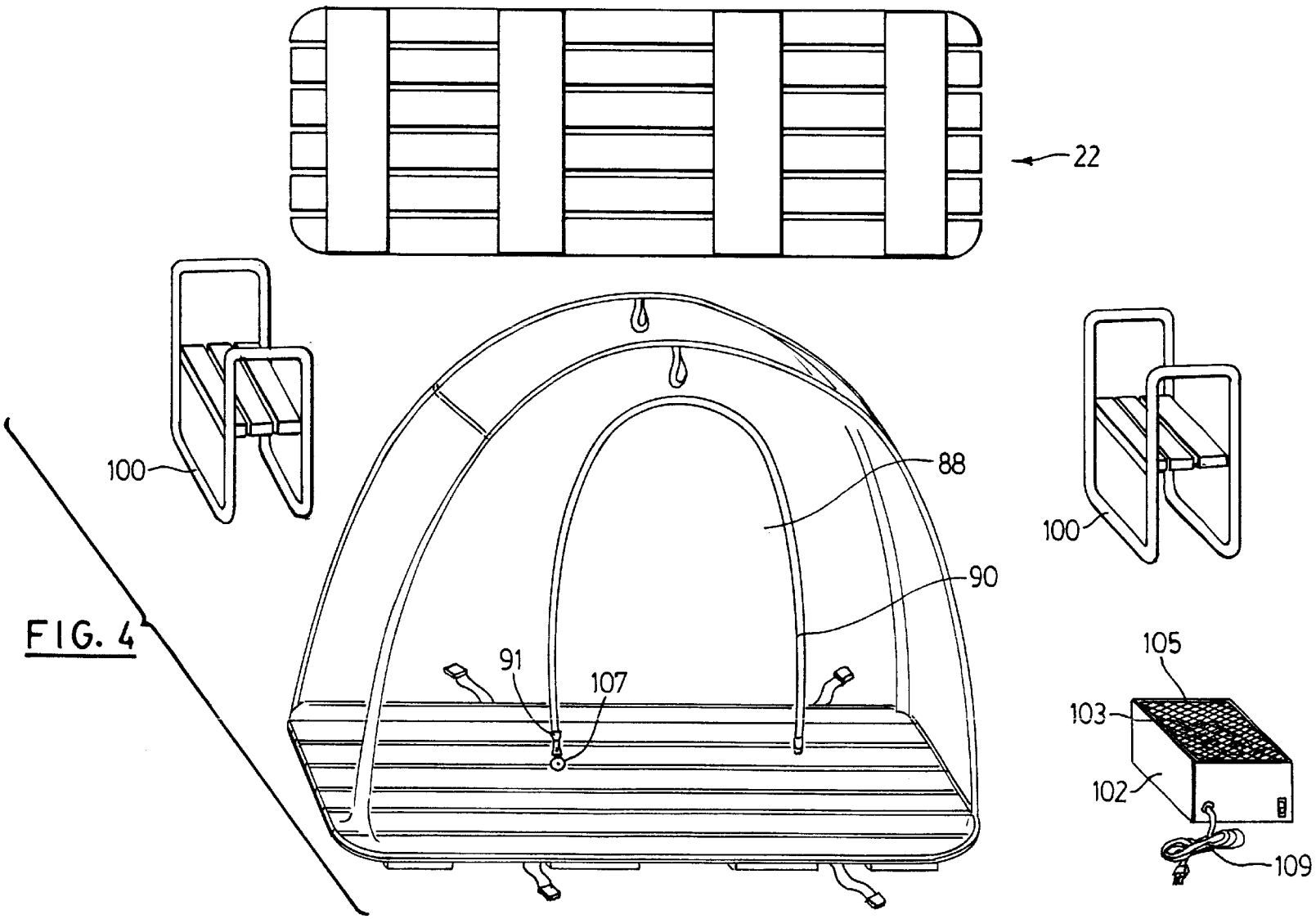
FIG. 4 is a perspective view of the components of a kit according to the present invention.

A portable sauna according to the present invention is generally illustrated by reference 20 in FIGS. 1, 4 and 7. FIG. 1 illustrates the portable sauna 20 according to the present invention in an erected configuration mounted within a bathtub. Preferably the portable sauna 20 is dimensioned to fit within a bathtub 21 as a bathtub 21 provides a structure having a drain for draining any moisture associated with sauna use.

In a preferred embodiment, the sauna has a base 22 made up of spaced apart cedar slats 34. It will be appreciated by those skilled in such structures that other materials and base arrangements are possible however cedar slats are desirable for a few reasons. Cedar is relatively durable in a moist environment and not easily subject to warpage or rot. Furthermore cedar has a pleasing aroma generally associated with saunas which will give the portable sauna a more authentic ambiance. Finally, the slat-like configuration allows moisture draining and drying out of the sauna after use and prevents puddling during use.

Figure 5:
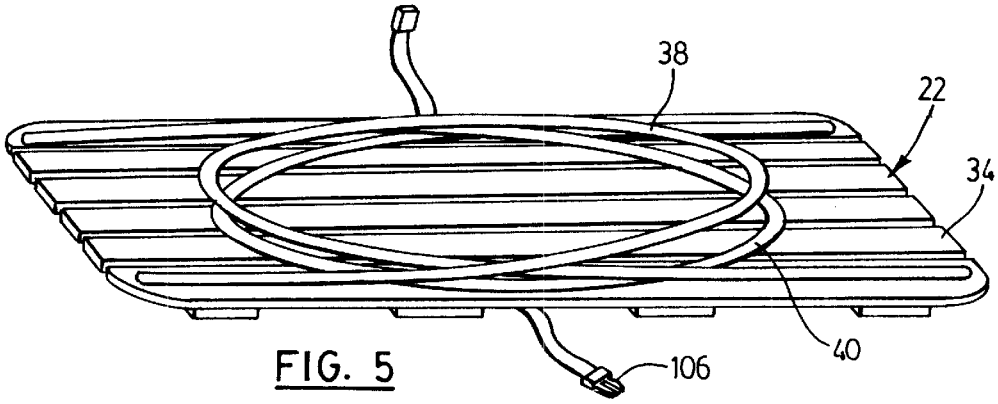
FIG. 5 is a perspective view illustrating a frame and a base in a collapsed configuration.
Figure 6:
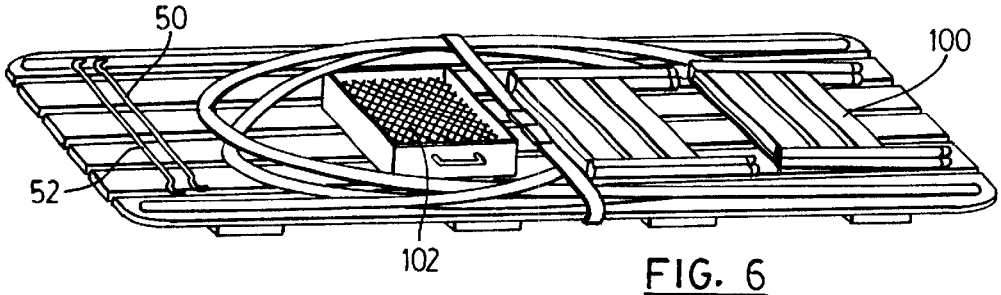
FIG. 6 is a perspective view corresponding to FIG. 5 but also showing a sauna box and a chair in a knockdown configuration secured on the base.

The sauna 20 is collapsible so as to be portable and accordingly includes a collapsible frame assembly 24 having frame members 38 and 40 extending substantially from one end of the base 22 to its opposite end adjacent respective sides of the base. The frame members 38 and 40 are of a material conducive to resilient bending such as, for example glass reinforced plastics or polymer materials. As shown in FIGS. 5 and 6, the frame members 38 and 40 may be twisted into hoops. Respective assist straps 101 and 99 may be provided to assist in the collapsing of the frame members 38 and 40. A strap 106 may be provided to hold the frame members 38 and 40 in their collapsed configuration to the base 22.

Figure 2:
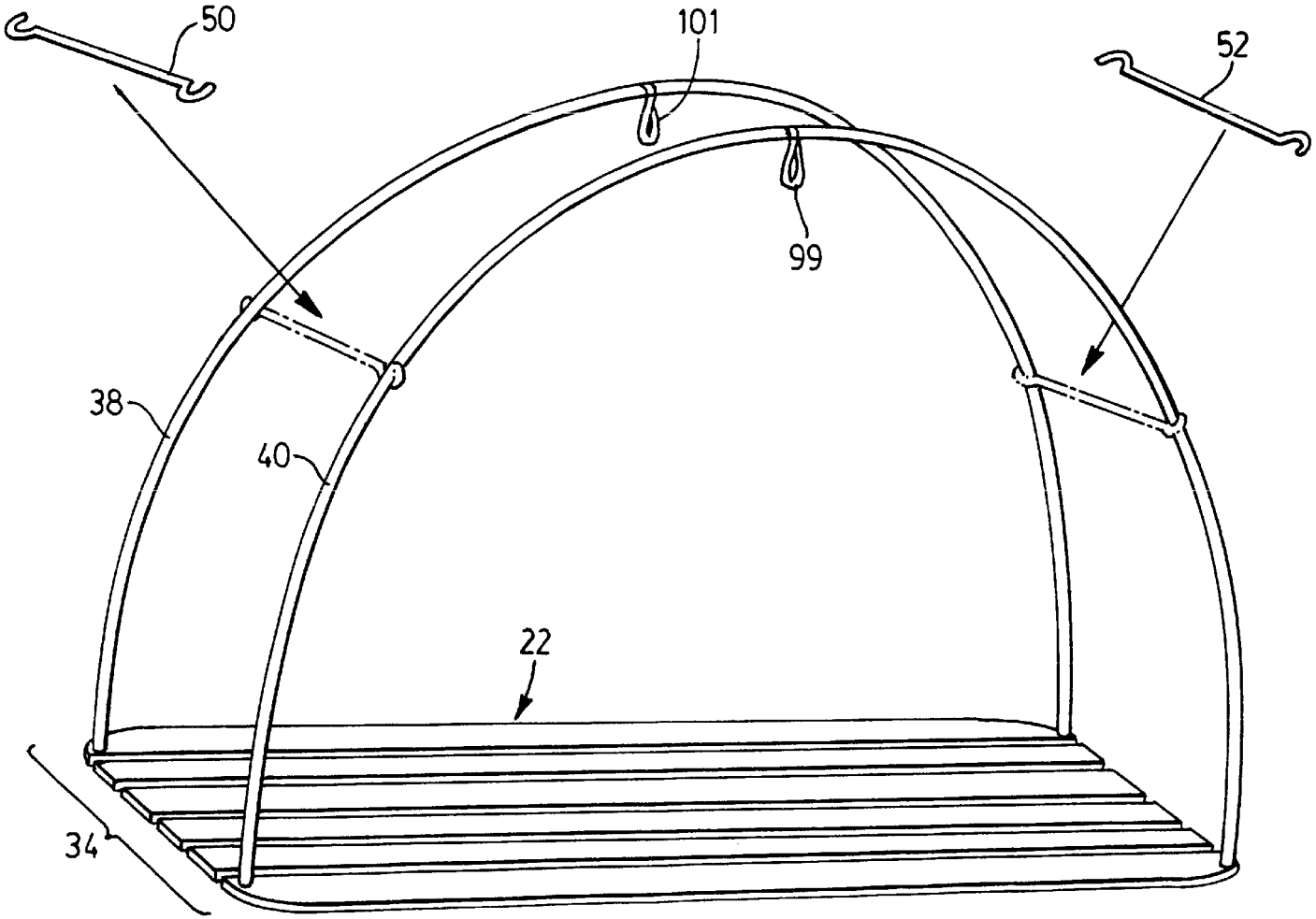
FIG. 2 is a perspective view of a frame assembly of the portable sauna of FIG. 1.

FIG. 2 illustrates the frame members 38 and 40 of the frame in an erected configuration. Crossmembers 50 and 52 may be provided to maintain the frame members 38 and 40 in a spaced apart relationship to improve the overall structural rigidity of the frame.

The frame assembly 24 supports a collapsible cladding 30. Preferably the collapsible cladding 30 will be of a translucent sheet material to at least admit light thereby obviating the need for providing lighting within a closure. It may also be desirable to have the collapsible cladding material transparent to render the portable sauna 20 less claustrophobic. Polymer sheeting material might be selected for the collapsible cladding. Possibly woven fabric such as canvas or nylon may be used if transparency is not required.

As moisture from within the enclosure will typically condense on the cladding 30, preferably the enclosure will be shaped so as to direct any such condensed moisture along the cladding 30 rather than have it drip on any occupants. This may be accomplished by providing a top 31 with a downwardly facing generally concave shape such as the arched shape illustrated in FIGS. 1 and 4.

In order to permit ingress and egress a doorway 90 maybe provided through the cladding 30 along with a door 88 for closing the doorway 90. A zipper such as illustrated by reference 91 or other interactive fastener means may be provided to hold the door 88 closed.

A heat source 28 is provided for supplying heat to the enclosure. A preferred heat source is a sauna box such as illustrated by reference 102 in FIG. 4 having a heating element therein (not illustrated) covered by sauna rocks 103 and provided with a mesh guard 105 to prevent any inadvertent contact between the occupants of the sauna and the heating element. More preferably, the sauna box 102 will also be also properly sealed to allow water to be poured on the rocks to generate steam. Assuming an electrically powered heat source 28 is used, the cladding 30 may be provided with a grommet or suitable opening 107 to admit passage of an electrical cord 109 associated with the heat source 28.

Figure 3A:
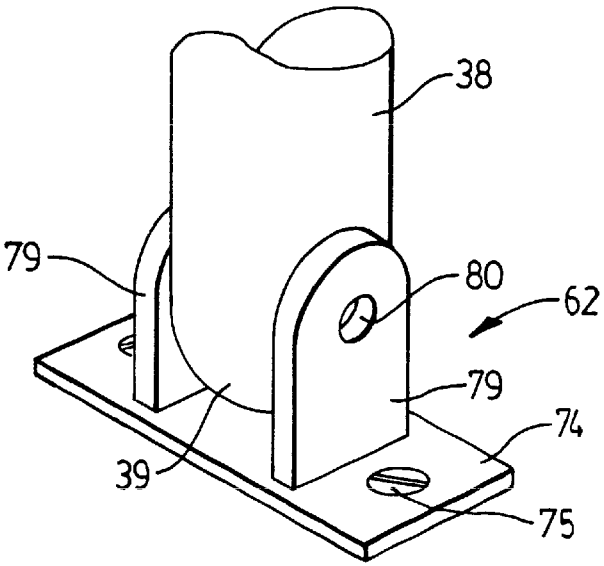
FIG. 3A is an enlarged perspective view of the encircled are in FIG. 3.
Figure 3:
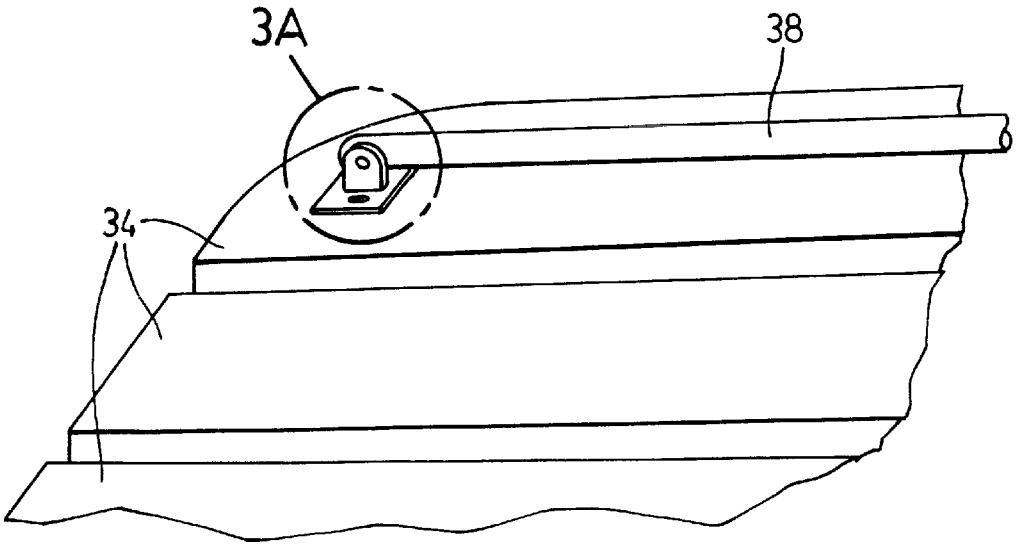
FIG. 3 is a perspective view of a portion of a base and a frame member according to the present invention.

Although a base 22 is not entirely necessary, as the enclosure may be open at its bottom or the cladding may extend across the bottom, for the reasons set out above it is believed that a moisture permeable base 22 would be preferable. Assuming that a base 22 is used, the frame members 38 and 40 may be affixed to the base using a hinged joint such as illustrated by reference 62 and FIG. 3A. The joint has a base 74 securable to a slat 34 by screws 75. The joint furthermore has a pair of upstanding members 79 with a pin 80 extending there between and through an end 39 of the frame member 38.

As some sauna users like to douse themselves with cold water as part of the sauna experience, provision is made in the cladding 30 of the enclosure to admit water. In this regard, flaps 33 are provided in the top 31 which may be opened and through which water from a shower head 89 may be directed (or through which a user may stand). Alternatively, or in addition, further flaps 35 may be provide toward opposite ends of the enclosure for admitting a handheld shower (not shown) or a faucet 37. It may also be desirable to provide the sauna box with a cover (not shown) to shield it from excess water (or any water if not a steam generating unit).

Seats 100 may be provided to give the occupants of the sauna a place to sit. The seats 100 may be of a knockdown configuration as illustrated in FIG. 6 to provide for more easy storage, however, this is not entirely necessary.

Figure 7:
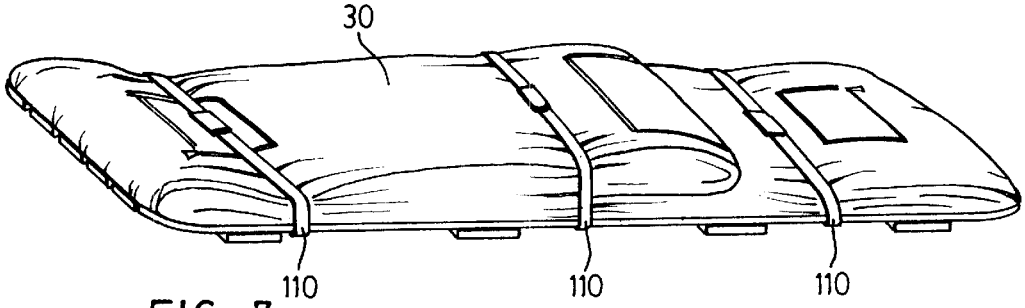
FIG. 7 is a perspective view corresponding to FIGS. 5 and 6 but additionally showing a folded up cladding secured over the base and remaining components; and, FIG. 8 is a perspective view illustrating a carrying case for a portable sauna according to the present invention.

FIGS. 5 through 7 illustrate the storage of the sauna. As illustrated in FIG. 5, the frame members 38 and 40 are initially collapsed and secured to the base 22 with a strap 106. As shown in FIG. 6, cross members 50 and 52 may be placed on the base 22 and as well the seats 100 and sauna rock box 102.

As further shown in FIG. 7, the cladding material 30 may be folded and placed on top of the items illustrated in FIG. 6 and secured in place with additional straps 110.

Figure 8:
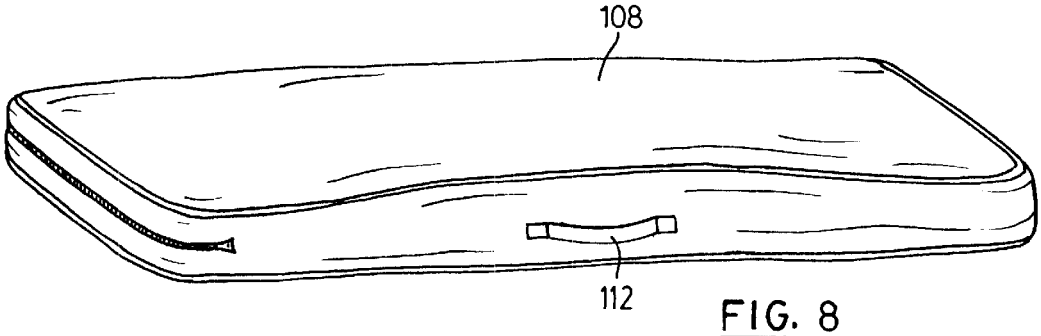

Finally, as illustrated in FIG. 8, a cover 108 having a handle 112 may be provided to assist in orderly storage and portability.

The above description is intended in an illustrative rather than a restrictive sense. Variations to the specific structure described may be apparent to persons skilled in the art without departing from the spirit and scope of the present invention which is defined by the claims set out below.

We claim:

1. A portable sauna comprising:

a collapsible frame dimensioned to fit within a bathtub and configurable between an erected and a collapsed configuration by resilient bending;

a collapsible cladding mountable over said frame and defining an enclosure when said frame is in said erected configuration said enclosure having a downwardly facing generally concave shaped top to direct any moisture condensing thereon along said collapsible cladding;

a doorway through said cladding permitting ingress and egress;

a door mounted to said cladding for closing said doorway;

a sauna box mountable within said enclosure; and a moisture permeable base within said enclosure.

2. A portable sauna is claimed in claim 1 wherein:

said collapsible frame is hingedly secured to said base; and, said base is made from spaced apart cedar slats.

3. A portable sauna as claimed in claim 2 further including at least one coverable opening through said cladding for admitting water from a water source into said enclosure.

4. A portable sauna as claimed in claim 3 further including at least one seat erectable within said enclosure.

5. A portable sauna as claimed in claim 4 wherein said seat is of knock-down configuration.

6. A portable sauna kit comprising:

a base dimensioned to fit within a bathtub;

a collapsible frame mounted to said base and configurable by resilient bending between an erected and a collapsed configuration;

a collapsible cladding mountable over said frame to define an enclosure when said frame is in said erected configuration, said cladding including a doorway there through permitting ingress and egress and a door for covering said doorway;

said enclosure, when erected, having a downwardly facing generally concave shaped top to direct any moisture condensing thereon along said cladding;

a steam generator;

at least one seat receivable within said enclosure;

said base is of cedar slats which are spaced apart to allow drainage of said moisture; and, said cladding is of a translucent flexible sheeting material.

7. A portable sauna kit as claimed in claim 6 wherein: said seats are of knock-down configuration and include a seating surface of cedar.

8. A portable sauna kit as claimed in claim 6 wherein said cladding material includes at least one coverable opening for admitting water from an external water source.

9. A portable sauna kit as claimed in claim 8 further including a carrying case for containing said base, said collapsible cladding, said steam generator and at least one seat;

said carrying case further including at least one handle to assist in its moving.

* * * * *